US007221248B2

(12) United States Patent
Mitteer et al.

(10) Patent No.: US 7,221,248 B2
(45) Date of Patent: May 22, 2007

(54) SOLENOID WITH NOISE REDUCTION

(75) Inventors: David M. Mitteer, Shelby, MI (US); Scott W. Piper, Rothbury, MI (US)

(73) Assignee: Grand Haven Stamped Products, Grand Haven, MI (US)

( * ) Notice: Subject to any disclaimer, the term of this patent is extended or adjusted under 35 U.S.C. 154(b) by 130 days.

(21) Appl. No.: 10/762,837

(22) Filed: Jan. 22, 2004

(65) Prior Publication Data

US 2004/0227604 A1 Nov. 18, 2004

Related U.S. Application Data

(60) Provisional application No. 60/511,421, filed on Oct. 13, 2003, provisional application No. 60/470,609, filed on May 15, 2003.

(51) Int. Cl.
*H01F 7/00* (2006.01)

(52) U.S. Cl. ..... 335/229; 335/220

(58) Field of Classification Search ..... 335/220–229
See application file for complete search history.

(56) References Cited

U.S. PATENT DOCUMENTS 2,353,835 A * 7/1944 Lane et al. ..... 335/260
4,533,890 A * 8/1985 Patel ..... 335/234
4,690,371 A * 9/1987 Bosley et al. ..... 251/65
4,987,792 A 1/1991 Mueller et al.
5,070,740 A 12/1991 Giek et al.
5,150,633 A 9/1992 Hillgärtner
5,357,820 A 10/1994 Moroto et al.
5,415,056 A 5/1995 Tabata et al.
5,494,141 A 2/1996 Osborn et al.
5,503,366 A * 4/1996 Zabeck et al. ..... 251/129.18
5,622,079 A 4/1997 Woeste et al.
5,677,658 A 10/1997 Osborn et al.
5,680,307 A 10/1997 Issa et al.
5,689,996 A 11/1997 Ersoy
5,718,312 A 2/1998 Osborn et al.
5,759,132 A 6/1998 Osborn et al.
5,768,944 A 6/1998 Inuzuka et al.
5,791,197 A 8/1998 Rempinski et al.
5,845,535 A 12/1998 Wakabayashi et al.
5,861,803 A 1/1999 Issa
5,899,115 A 5/1999 Kataumi et al.
5,903,203 A * 5/1999 Elenbaas ..... 335/179
5,913,935 A 6/1999 Anderson et al.
5,927,150 A 7/1999 Hirano et al.

(Continued)

*Primary Examiner*—Elvin Enad
*Assistant Examiner*—Bernard Rojas
(74) *Attorney, Agent, or Firm*—Price, Heneveld, Cooper, DeWitt & Litton, LLP

(57) ABSTRACT

A solenoid having a housing and a coil disposed in the housing for generating a magnetic field when an electric current passes through the coil. A center pole is disposed within the coil, and the center pole is made of a ferromagnetic material. A rod assembly is movably disposed in the housing for movement between a rest position and an energized position. The rod assembly has a portion thereof disposed in the center pole, and includes a magnet having a polarity causing the magnet to be repelled from the center pole when an electric current passes through the coil. The magnet is encapsulated by an elastomeric material that contacts a stop surface when in the rest position to reduce noise resulting from shifting of the rod assembly from the energized position to the rest position.

25 Claims, 3 Drawing Sheets

U.S. PATENT DOCUMENTS 5,934,145 A 8/1999 Ersoy et al.
5,955,934 A * 9/1999 Raj ..... 335/277
6,019,344 A * 2/2000 Engel et al. ..... 251/64
6,040,752 A * 3/2000 Fisher ..... 335/234
6,089,118 A 7/2000 Ishii et al.
6,098,483 A 8/2000 Syamoto et al.
6,125,714 A 10/2000 Woeste et al.
6,148,686 A 11/2000 Kataumi
6,151,977 A 11/2000 Menig et al.
6,192,770 B1 2/2001 Miyoshi et al.
6,196,080 B1 3/2001 Lee
6,209,408 B1 4/2001 DeJonge et al.
6,209,410 B1 4/2001 Suzuki
6,223,112 B1 4/2001 Nishino
6,230,579 B1 5/2001 Reasoner et al.
6,237,435 B1 5/2001 Grönhage et al.
6,260,432 B1 7/2001 Ehrmaier et al.
6,311,577 B1 11/2001 Wörner et al.
6,325,196 B1 12/2001 Beattie et al.
6,382,046 B1 5/2002 Wang
6,401,564 B1 6/2002 Lee
6,405,611 B1 6/2002 DeJonge et al.
6,408,709 B2 6/2002 Kim
6,422,106 B1 7/2002 Lee
6,431,339 B1 8/2002 Beattie et al.
6,439,073 B2 8/2002 Ohashi et al.
6,443,024 B1 9/2002 Skogward
6,474,186 B1 11/2002 Vollmar
6,512,435 B2 * 1/2003 van Namen ..... 335/234
6,530,293 B1 3/2003 Rückert et al.
6,536,299 B2 3/2003 Kim
6,550,351 B1 4/2003 O'Reilly et al.
6,553,858 B1 4/2003 Kim
6,568,294 B2 5/2003 Jezewski
6,612,194 B2 9/2003 DeJonge
6,644,142 B2 11/2003 Junge et al.
6,658,952 B2 12/2003 Hayashi et al.
6,732,847 B1 5/2004 Wang
6,761,081 B2 7/2004 Kliemannel
6,761,084 B2 7/2004 Suzuki et al.
6,773,369 B2 8/2004 Altenkirch et al.
6,783,480 B2 8/2004 Masuda et al.
6,848,331 B2 2/2005 Syamoto
6,848,332 B2 2/2005 Hayashi et al.
6,857,335 B2 2/2005 Kahara
6,865,967 B2 3/2005 Shioji et al.
2003/0172757 A1 9/2003 Yone
2003/0172762 A1 9/2003 Ehrmaier et al.
2003/0188594 A1 10/2003 Levin et al.
2003/0213327 A1 11/2003 Syamoto
2004/0000210 A1 1/2004 Cho
2004/0035237 A1 2/2004 Matsui et al.
2004/0045392 A1 3/2004 Wakayama
2004/0162185 A1 8/2004 Giefer et al.
2004/0168537 A1 9/2004 Koontz
2004/0194567 A1 10/2004 Giefer et al.
2004/0216546 A1 11/2004 Shiomi et al.
2004/0216547 A1 11/2004 Shiomi et al.
2004/0216549 A1 11/2004 Shiomi et al.
2004/0237692 A1 12/2004 Syamoto et al.
2004/0237693 A1 12/2004 Koide
2005/0024174 A1 * 2/2005 Kolb et al. ..... 335/220
2005/0028633 A1 2/2005 Giefer et al.

* cited by examiner

SOLENOID WITH NOISE REDUCTION

CROSS-REFERENCE TO RELATED APPLICATIONS

The present application claims the benefit of U.S. Provisional Application No. 60/470,609, filed May 15, 2003, and also claims the benefit of U.S. Provisional Application No. 60/511,421, filed Oct. 13, 2003, the entire contents of each of which are incorporated by reference.

BACKGROUND OF THE INVENTION

Various types of solenoids have been developed to provide electrically powered linear motion. Such solenoids typically include either a soft magnetic material or a permanent magnet comprising the moving mass, and a coil. When the solenoid is in the deenergized or rest position, a portion of the moving mass is in contact with a stop surface. When the coil is electrically energized, the moving mass shifts away from the stop surface. When the coil is deenergized, the moving mass shifts back to the rest position, contacting the stop surface. The impact of the moving mass on the stop surface can create substantial noise that may not be acceptable for certain applications. Efforts to reduce this noise have included utilizing a separate resilient member such as a rubber washer or the like to reduce the noise otherwise caused by the moving mass impacting the stop surface when it shifts to the rest position. However, such resilient stops create added complexity and costs, and may also be prone to degradation.

SUMMARY OF THE INVENTION

One aspect of the present invention is a solenoid having a housing and a coil disposed in the housing for generating a magnetic field when an electric current passes through the coil. A center pole is disposed within the coil, and the center pole is made of a ferromagnetic material. A rod assembly is movably disposed in the housing for movement between a rest position and an energized position. The rod assembly has a portion thereof disposed in the center pole, and includes a magnet having a polarity causing the magnet to be repelled from the center pole when an electric current passes through the coil. The magnet is encapsulated by an elastomeric material that contacts a stop surface when in the rest position to reduce noise resulting from shifting of the rod assembly from the energized position to the rest position.

Another aspect of the present invention is a rod assembly for an electrically powered linear actuator. The rod assembly includes an elongated body made of a first material having a first melting temperature. A magnet is connected to the elongated body, and a second material encapsulates at least a portion of the magnet. The second material has a second melting temperature that is less than the first melting temperature.

Yet another aspect of the present invention is a method of making a rod assembly for an electrically powered linear actuator. The method includes molding a body portion of a first material having a first reflow temperature. A magnet is provided, and the magnet is overmolded with a second material having an injection molding temperature that is less than the reflow temperature of the first material to thereby form a damper.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
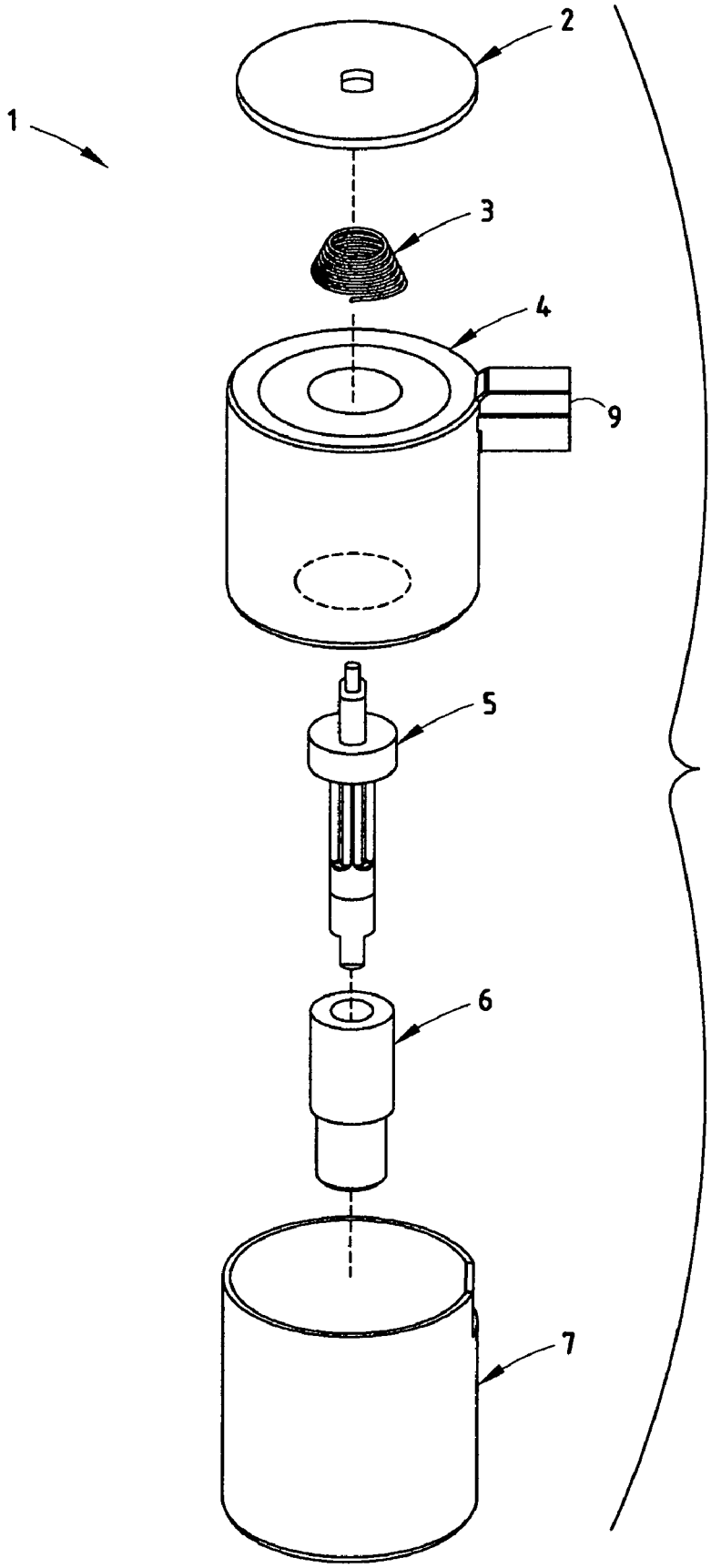
FIG. 1 is an exploded perspective view of a solenoid according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a solenoid 1 according to the present invention includes a flux washer 2, spring 3, coil bobbin assembly 4, a rod assembly 5, center pole 6, and housing 7. The flux washer 2, center pole 6, and housing 7 are preferably made of steel or other ferromagnetic material to increase the force of the magnetic field generated by the coil bobbin assembly 4. The coil bobbin assembly 4 is of a substantially conventional design, and includes an electrical coil 8 and electrical connectors 9 to provide an electrical field for actuating the solenoid 1.

Figure 2:
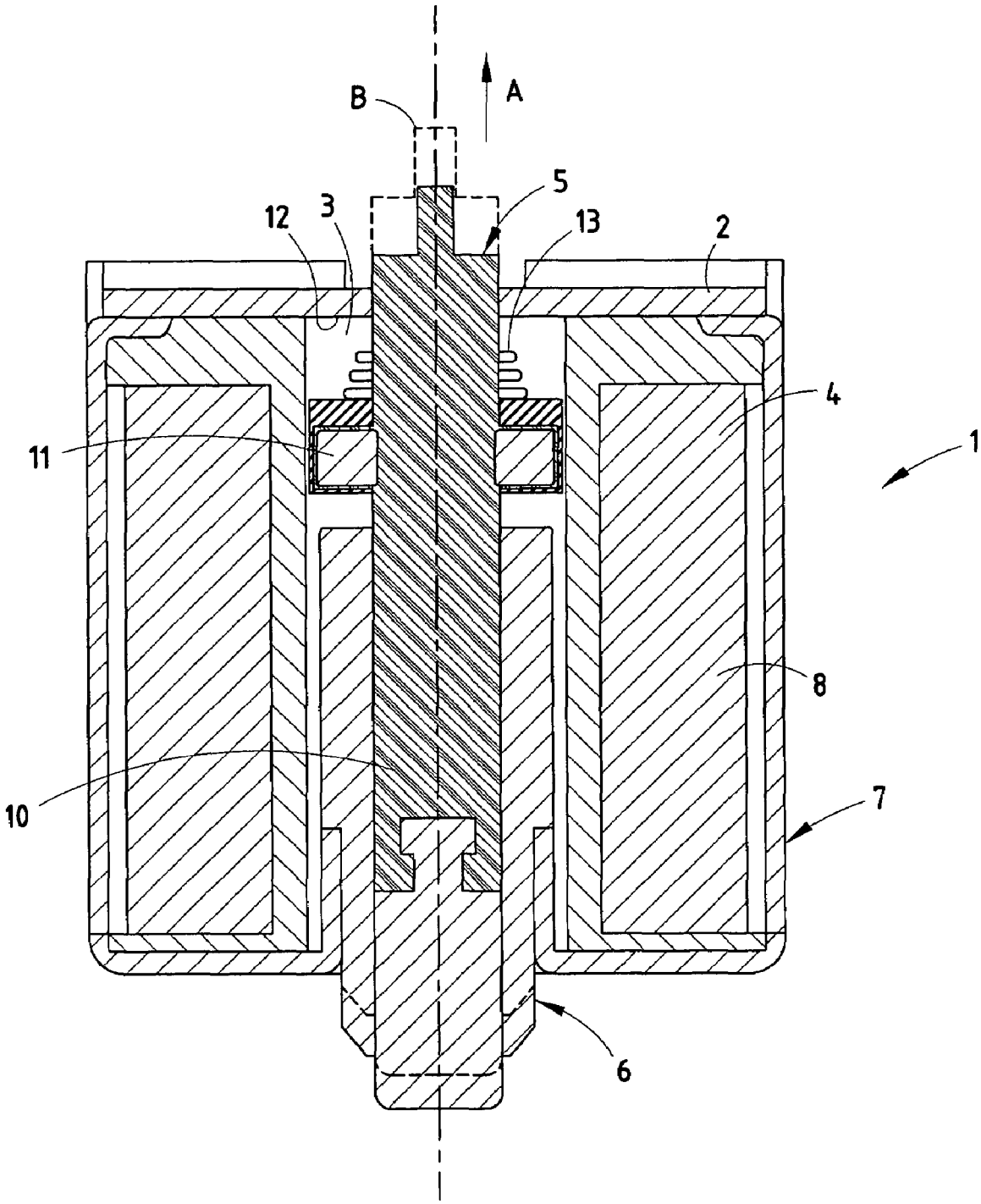
FIG. 2 is a cross-sectional view of the solenoid of FIG. 1 when in an assembled condition.

With further reference to FIG. 2, when in an assembled condition, the center pole 6 is secured to the housing 7, and the rod assembly 5 has a portion 10 thereof disposed within the center pole 6. The rod assembly 5 includes a magnet 11 that is generally ring-like, with a polarity that causes the rod assembly 5 to shift in the direction of the arrow "A" when the coil 8 is energized. The rod assembly 5 shifts to the position "B" shown in dashed lines when the coil 8 is energized. When in the position B, the spring 3 contacts the inner surface 12 of flux washer 2, and compresses to cause a force tending to bias the rod assembly 5 to the rest or deenergized position. Also, because the center pole 6 is made of steel or other ferromagnetic material, the magnet 11 also has a magnetic attraction to the center pole 6 tending to return the rod assembly 5 to the rest position. The length of the spring 3 may be selected such that a gap is formed between the end 13 of spring 3 and surface 12 when rod assembly 5 is in the rest position. The length and the stiffness of the spring 3 can then be selected to provide just enough force to move the rod assembly 5 to a point close enough to center pole 6 wherein the magnetic force of the magnet 11 is sufficient to move the rod assembly 5 to the rest position by itself, without further assist from the spring 3. In this way, the amount of force required to overcome the bias of spring 3 can be minimized, thereby minimizing the force that must be generated by the coil 8 and magnet 11 to retain the rod assembly 5 in the extended or energized position. Spring 3 may be not be necessary if the desired travel of the rod assembly is small enough such that the force of the magnet 11 is sufficient enough to move the rod assembly 5 to the rest position by itself.

Figure 3:
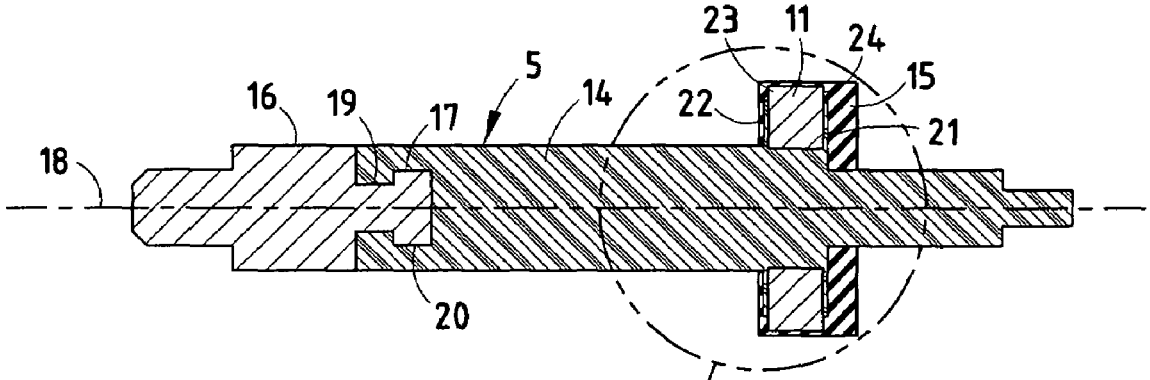
FIG. 3 is a cross-sectional view of the rod assembly of the solenoid of FIG. 1.
Figure 4:
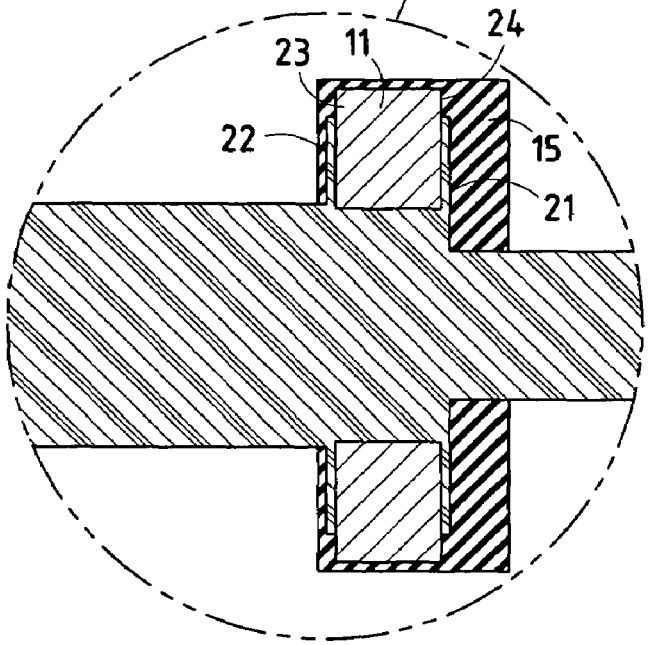
FIG. 4 is an enlarged view of a portion of the rod assembly.

With further reference to FIGS. 3 and 4, the rod assembly 5 includes a body portion 14 that is preferably made of a polymer material such as a glass fiber reinforced nylon material. A damper 15 is made of an elastomeric material, and is molded around the magnet 11 to thereby encapsulate the magnet 11. The damper 15 is preferably made of a material having between about thirty-five to ninety Shore A durometer material, most preferably about sixty Shore A. The particular hardness and other material properties selected will depend upon the degree of noise reduction, durability, and the like required for a particular application. Also, the elastomeric material utilized to mold the damper 15 has an injection molding temperature that is less than the reflow temperature of the polymer material of the body 14 of rod assembly 5. An end piece 16 is made of a non-ferromagnetic material, such as austenitic stainless steel. The end piece 16 provides a structurally strong engagement member that is capable of reacting relatively large shear loads when the solenoid 1 is used in applications such as in an electrical pawl for a shifter of a motor vehicle. The end piece 16 may be made of other non-ferromagnetic materials having the required degree of strength, impact resistance, wear characteristics, and the like as required for a particular application. The end piece 16 includes a connector portion 17 that extends in the direction of the axis 18 of rod assembly 5. Connector 17 includes a portion 19 having a circular cross-sectional shape, and an end portion 20 that also has a circular cross-sectional shape. End portion 20 has a larger diameter than portion 19, such that the end piece 16 is securely connected to the main body portion 14.

During fabrication, the end piece 16 is positioned in a mold (not shown), and the body portion 14 is molded around the connector 17 of end piece 16. The magnet 11 is also positioned in the mold prior to the molding process. The mold shape is such that the body portion 14 forms outwardly extending flanges 21 and 22 in contact with the opposite side surfaces 23 and 24 of magnet 11. The magnet 11 is thereby securely molded to the body portion 14. After the body 14 is formed, the damper 15 is then molded over the magnet 11 and flanges 21 and 22 to thereby encapsulate the magnet 11.

The integral damper formed by overmolding the magnet provides a durable, cost effective way to reduce noise that would otherwise occur during operation of the solenoid. Furthermore, if the magnet is made of a material tending to flake or otherwise degrade, encapsulating the magnet with the dampening material prevents pieces of the magnet from becoming loose and potentially interfering with proper operation of the solenoid.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An electrically powered actuator, comprising:

a housing;

a coil disposed in the housing for generating a magnetic field when an electric current passes through the coil;

a center pole disposed within the coil, wherein the center pole is made of a ferromagnetic material;

a rod assembly movably disposed in the housing for movement between a rest position and an energized position, the rod assembly having a portion thereof disposed in the center pole, and including a magnet having a polarity causing the magnet to be repelled from the center pole when an electric current passes through the coil; and wherein:

the magnet is encapsulated by an elastomeric material that contacts a stop surface when in the rest position to reduce noise resulting from shifting of the rod assembly from the energized position to the rest position.

2. The electrically powered actuator of claim 1, wherein:

the rod assembly has an elongated body portion comprising a polymer material.

3. An electrically powered actuator, comprising:

a housing;

a coil disposed in the housing for generating a magnetic field when an electric current passes through the coil;

a center pole disposed with coil, wherein the center pole is made of a ferromagnetic material;

a rod assembly movably disposed in the housing for movement between a rest position and an energized position, the rod assembly having an elongated body portion comprising a polymer material, and wherein a portion of the rod assembly is disposed in the center pole, and including a magnet having a polarity causing the magnet to be repelled from the center pole when an electric current passes through the coil;

the magnet is encapsulated by an elastomeric material that contacts a stop surface when in the rest position to reduce noise resulting from shifting of the rod assembly from the energized position to the rest position; and wherein:

the polymer material has a reflow temperature that is greater than the injection molding temperature of the elastomeric material.

4. The electrically powered actuator of claim 3, wherein:

the magnet is generally disk-shaped with generally parallel side surfaces and an opening extending between the side surfaces, and wherein the body portion extends along the side surfaces to retain the magnet.

5. The electrically powered actuator of claim 4, wherein:

the body portion includes a pair of outwardly extending flanges forming an annular groove therebetween having a base surface and parallel sidewall surfaces, the base surface and the sidewall surfaces contacting the magnet.

6. The electrically powered actuator of claim 2, wherein:

the magnet is positioned adjacent a first end of the rod assembly; and wherein:

the rod assembly includes a pawl member made of a non-ferromagnetic material at a second end of the rod assembly, the pawl member being made of material that is substantially harder than the polymer material of the body portion.

7. The electrically powered actuator of claim 6, wherein:

at least a portion of the pawl member extends outside of the housing when the rod assembly is in the rest position.

8. The electrically powered actuator, comprising:

a housing;

a coil disposed in the housing for generating a magnetic field when an electric current passes through the coil;

a center pole disposed within the coil, wherein the center pole is made of a ferromagnetic material;

a rod assembly movably disposed in the housing for movement between a rest position and an energized position, the rod assembly having a portion thereof disposed in the center pole, and including a magnet positioned adjacent a first end of the rod assembly having a polarity causing the magnet to be repelled from the center pole when an electric current passes through the coil, the rod assembly having an elongated body portion comprising a polymer material;

wherein the magnet is encapsulated by an elastomeric material that contacts a stop surface when in the rest position to reduce noise resulting from shifting of the rod assembly from the energized position to the rest position; and wherein:

the rod assembly includes a pawl member made of a non-ferromagnetic material at a second end of the rod assembly, the pawl member being made of material that is substantially harder than the polymer material of the body portion;

at least a portion of the pawl member extends outside of the housing when the rod assembly is in the rest position; and the pawl member is made of a stainless steel material, and the body portion is made of a fiber reinforced polymer material.

9. The electrically powered actuator of claim 8, wherein:

the rod assembly defines an axis and the pawl member includes a connector portion having a first portion extending in the direction of the axis, and a second portion extending transverse to the axis, the connector portion being encapsulated by the body portion.

10. A rod assembly for an electrically powered actuator, comprising:

an elongated body having at least a portion thereof made of a non-ferromagnetic first material having a first melting temperature;

a magnet connected to the elongated body; and a second material encapsulating at least a portion of the magnet, the second material having a second melting temperature that is less than the first melting temperature.

11. The rod assembly of claim 10, wherein:

the second material has a hardness between about thirty-five to ninety Shore A durometer to form a damper.

12. A rod assembly for an electrically powered actuator, comprising:

an elongated body made of a first material having a first melting temperature;

a magnet connected to the elongated body;

a second material encapsulating at least a portion of the magnet, the second material having a second melting temperature that is less than the first melting temperature; and wherein the first material comprises a polymer material.

13. The rod assembly of claim 12, wherein:

the polymer material is reinforced with fibers.

14. A rod assembly for an electrically powered actuator, comprising:

an elongated body made of a first material having a first melting temperature;

a magnet connected to the elongated body;

a second material encapsulating at least a portion of the magnet, the second material having a second melting temperature that is less than the first melting temperature; and wherein the magnet is generally disk-shaped with generally parallel side surfaces and an opening extending between the side surfaces, and wherein the body portion extends along the side surfaces to retain the magnet.

15. The rod assembly of claim 14, wherein:

the body portion includes a pair of outwardly extending flanges forming an annular groove therebetween having a base surface and parallel sidewall surfaces, the base surface and the sidewall surfaces contacting the magnet.

16. The rod assembly of claim 15, wherein:

the magnet is positioned adjacent a first end of the rod assembly; and wherein:

the rod assembly includes a pawl member made of a non-ferromagnetic material at a second end of the rod assembly, the pawl member being made of material that is substantially harder than the polymer material of the body portion.

17. A method of making an electrically powered actuator, comprising:

providing a housing;

positioning a coil in the housing;

positioning a center pole of a ferromagnetic material within the coil;

providing a rod assembly having a body portion of a first material;

providing a magnet;

positioning the magnet on the body portion; and encapsulating at least a portion of the magnet with an elastomeric second material to thereby form a damper that contacts a stop surface.

18. The method of claim 17, wherein:

the magnet is generally disk-shaped with opposite side surfaces and an opening extending between the opposite side surfaces; and the body portion includes retaining portions that are molded around portions of the opposite side surfaces of the magnet.

19. The method of claim 18, wherein:

a peripheral outer edge of the magnet is exposed after the body portion is molded around opposite side surfaces of the magnet, and the retaining portions comprise a pair of outwardly extending parallel flanges defining inner surfaces contacting the magnet and opposed outer surfaces; and including:

overmolding the second material around the peripheral outer edge of the magnet and around the opposed outer surfaces of the flanges.

20. The method of claim 19, wherein:

the second material has a Shore A hardness of about thirty-five to ninety durometer.

21. The method of claim 20, including:

providing a pawl member made of a non-ferromagnetic material and having a first end forming connecting structure; and molding the body portion around the connecting structure.

22. The method of claim 17, wherein:

the body portion is molded of a polymer material having a first melting temperature;

encapsulating at least a portion of the magnet includes overmolding the magnet with the second material; and the second material has a molding temperature that is less than the reflow temperature of the polymer material.

23. A rod assembly for an electrically powered actuator, comprising:

an elongated body made of a first material having a first melting temperature, the elongated body defining an exposed outer surface;

a magnet connected to the elongated body; and a second material encapsulating at least a portion of the magnet, the second material having a second melting temperature that is less than the first melting temperature, wherein the second material does not completely encapsulate the elongated body, such that a portion of the exposed outer surface is formed by the first material.

24. The rod assembly of claim 23, wherein: the first material is non-metallic.

25. The rod assembly of claim 23, wherein: the first material is a polymer.

* * * * *